US006000919A

United States Patent [19]

Hsieh

[11] Patent Number: 6,000,919

[45] Date of Patent: Dec. 14, 1999

[54] FAN WITH REDUCED THICKNESS

[76] Inventor: Hsin-Mao Hsieh, No. 6, East Section, Chiao Nan Li, Industrial 6th Rd., Pingtung City, Pingtung Hsien, Taiwan

[21] Appl. No.: 09/251,338

[22] Filed: Feb. 17, 1999

[51] Int. Cl.[6] ..... F04B 17/03

[52] U.S. Cl. ..... 417/423.15; 417/423.14; 415/220

[58] Field of Search ..... 415/220, 423.14, 415/423.15

[56] References Cited

U.S. PATENT DOCUMENTS

| | | | |
|---|---|---|---|
| 4,568,243 | 2/1986 | Schubert | 415/213 C |
| 4,861,237 | 8/1989 | Shiraki | 417/252 |
| 5,492,458 | 2/1996 | Horng | 417/423.7 |
| 5,924,849 | 7/1999 | Kirchgessner | 417/423.15 |

*Primary Examiner*—Timothy S. Thorpe
*Assistant Examiner*—Ehud Gartenberg
*Attorney, Agent, or Firm*—Bacon & Thomas, PLLC

[57] ABSTRACT

A fan includes a housing containing a receiving space and having one side containing a plurality of receiving recesses each connecting to the receiving space, a circuit board received in the receiving space and including a plurality of elongated extension pieces each secured in one of the receiving recesses, an axial sleeve mounted on the circuit board and received in the receiving space, a bearing mounted in the axial sleeve, a stator mounted on the axial sleeve and received in the receiving space, and fan blades rotatably received in the receiving space and including an axle rotatably mounted in the bearing.

6 Claims, 4 Drawing Sheets

FAN WITH REDUCED THICKNESS

CROSS-REFERENCES TO RELATED APPLICATIONS

Not Applicable.

BACKGROUND OF THE INVENTION

1. Field of the Invention

The present invention relates to a fan used in a notebook computer, and more particularly to a fan with a reduced thickness.

2. Description of the Related Art

A conventional fan in accordance with the prior art shown in FIGS. 5 and 6 is used in a notebook computer and comprises a housing (20) containing a receiving space (201) therein, four holes (203) one in each corner of the housing (20), a support base (202) mounted in the housing (20) and including a tube (204) received in the receiving space (201), a bearing (23) mounted in the tube (204), a circuit board (21) mounted on the tube (204), a stator (22) mounted on the tube (204), and a fan rotatably mounted on the stator (22) and an axle (241) rotatably mounted in the bearing (23). Each of four locking bolts (not shown) in turn extends through one of the corresponding holes (203) so as to secure the housing (20) to a radiator board (not shown) of the notebook computer. In such a manner, the fan blades (24) can be used to dissipate the heat produced by the central processing unit (not shown) of the notebook computer, thereby achieving a effect. However, it needs to additionally provide the support base (202) in the housing (20) to support the bearing (23), the circuit board (21), the stator (22), and the fan blades (24), thereby increasing the total thickness and weight of the fan. The present invention has arisen to mitigate and/or obviate the disadvantage of the conventional fan.

BRIEF SUMMARY OF THE INVENTION

In accordance with one aspect of the present invention, there is provided a fan comprising a housing containing a receiving space defined therethrough and having a first side and a second side, the first side containing a plurality of receiving recesses transversely defined therein each connecting to the receiving space; a circuit board received in the receiving space and including a plurality of elongated extension pieces each extending outward from the periphery thereof and each secured in one of the corresponding receiving recesses; an axial sleeve mounted on the circuit board and received in the receiving space; a bearing mounted in the axial sleeve; a stator mounted on the axial sleeve and received in the receiving space; and fan blades rotatably mounted on the stator and received in the receiving space, the fan blades including an axle rotatably mounted in the bearing.

The extension pieces are symmetrically arranged on the periphery of the circuit board, and the receiving recesses are symmetrically arranged in the first side of the housing.

Each of the extension pieces contains a locking hole defined therein, and each of the receiving recesses includes a locking stub securely received in the locking hole of one of the corresponding extension pieces.

Alternatively, each of the extension pieces contains a locking hole defined therein, each of the receiving recesses contains a locking bore defined therein and aligning with the locking hole of one of the corresponding extension pieces, and the fan further comprises a plurality of locking pins each extending through the locking hole of one of the corresponding extension pieces, and the locking bore of one of the corresponding recesses.

Further benefits and advantages of the present invention will become apparent after a carefull reading of the detailed description with appropriate reference to the accompanying drawings.

DETAILED DESCRIPTION OF THE INVENTION

Figure 1:
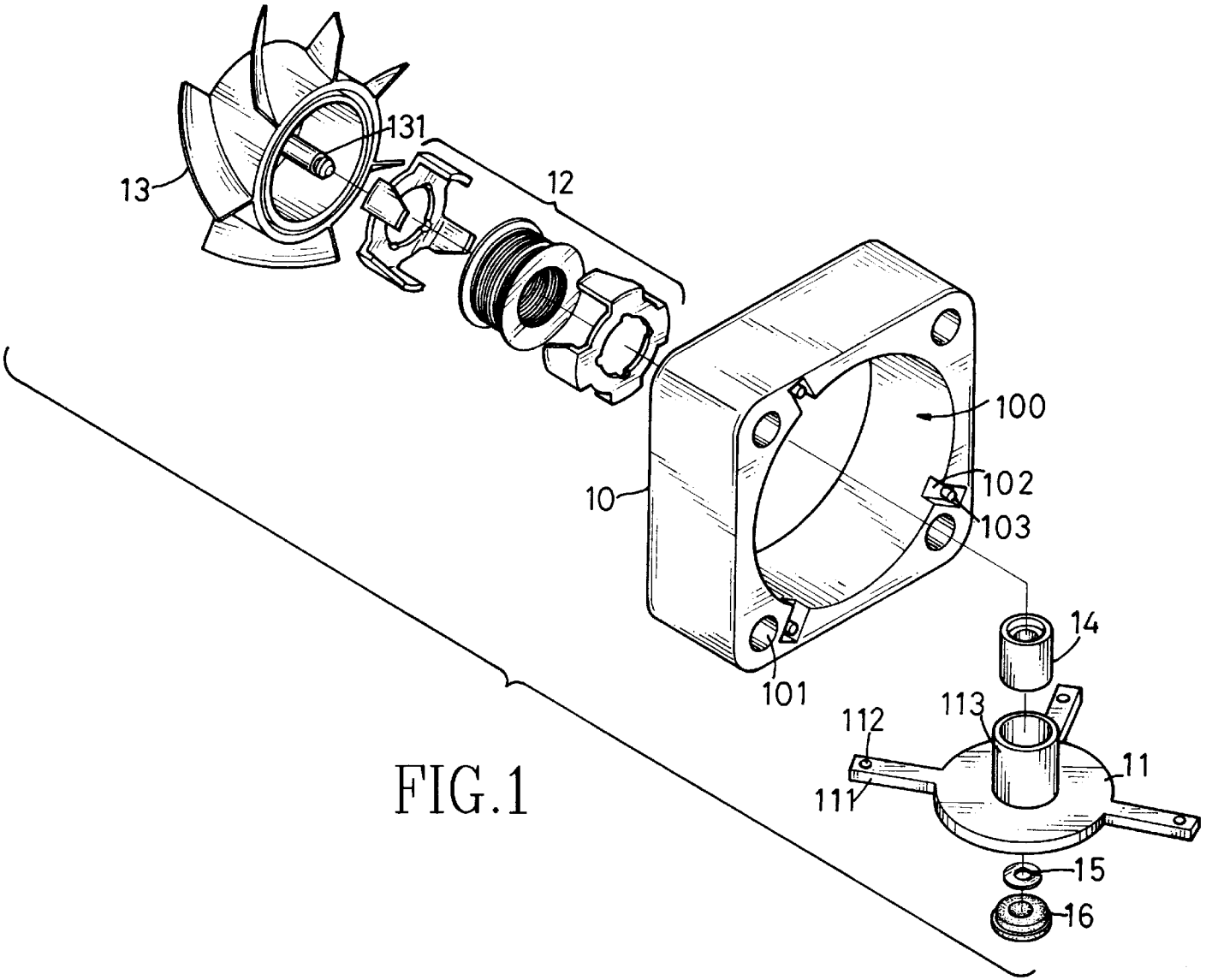
FIG. 1 is an exploded perspective view of a fan for a notebook computer in accordance with a first embodiment of the present invention.
Figure 2:
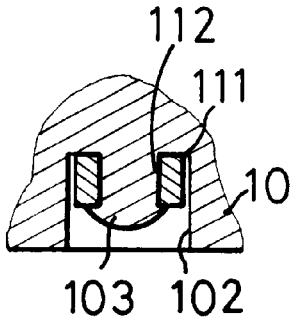
FIG. 2 is a top plan partially cut away cross-sectional assembly view of the fan as shown in FIG. 1.

Referring now to FIGS. 1 and 2, a fan in accordance with a first embodiment of the present invention can be used in a notebook computer, and comprises a housing (10) containing a receiving space (100) longitudinally defined therethrough and having a first side and a second side, the first side containing three receiving recesses (102) transversely defined therein each connecting to the receiving space (100), a circuit board (11) received in the receiving space (100) and including three elongated extension pieces (111) each extending outward from the periphery thereof and each secured in one of the corresponding receiving recesses (102), an axial sleeve (113) integrally formed on the circuit board (11) and received in the receiving space (100), a bearing (14) mounted in the axial sleeve (113), a stator (12) mounted on the axial sleeve (113) and received in the receiving space (100), and fan blades (13) rotatably mounted on the stator (12) and received in the receiving space (100), and including an axle (131) rotatably mounted in the bearing (14).

The extension pieces (111) are symmetrically arranged on the periphery of the circuit board (11), and the receiving recesses (102) are symmetrically arranged in the first side of the housing (10).

Each of the three extension pieces (111) contains a locking hole (112) defined therein, and each of the three receiving recesses (102) includes a locking stub (103) secured in the locking hole (112) of one of the corresponding extension pieces (111).

In assembly, the circuit board (11) is secured in the receiving space (100) of the housing (10) by means of each of the locking stubs (103) being inserted into the respective locking hole (112). Alternatively, each of the locking stubs (103) can be tightly bonded in the respective locking hole (112) by means of a pressurizing and heating welding treatment such that the circuit board (11) is integrally formed with the housing (10). The bearing (14) is then received in the axial sleeve (113), and the stator (12) is mounted on the axial sleeve (113). Then, the fan blades (13) are rotatably mounted on the stator (12) with the axle (131) rotatably mounted in the bearing (14). A C-ring (15) is then secured to one end of the axle (131), and a seal (16) is mounted to one end of the axial sleeve (113), thereby finishing the assembly of the fan.

The housing (10) contains four locking bores (101) therein each defined through the periphery thereof whereby the housing (10) can be attached to a radiator board (not shown) of the notebook computer by means of four locking bolts (not shown), thereby securing the fan to the radiator board of the notebook computer. In such a manner, the fan blades (13) can be used to dissipate the heat produced by the central processing unit (not shown) of the notebook computer, thereby achieving a cooling effect.

Figure 4:
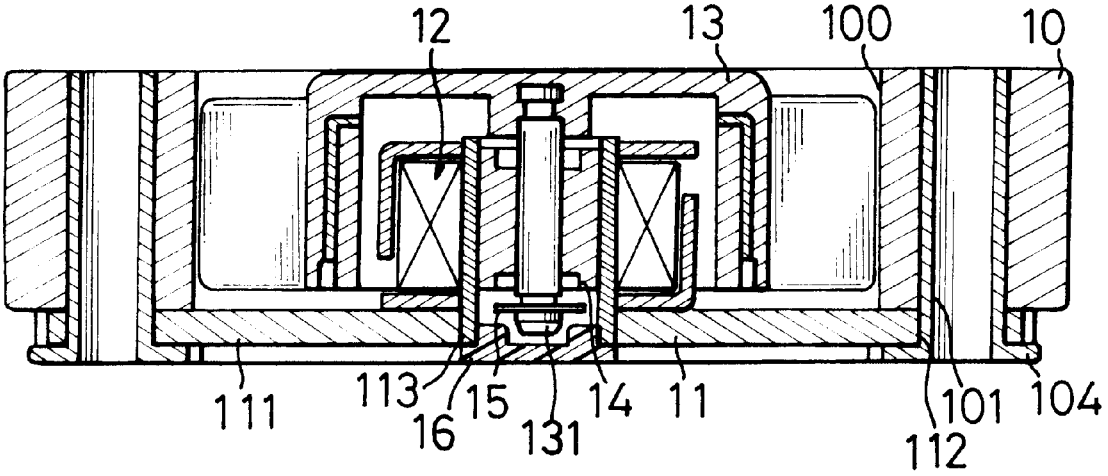
FIG. 4 is a top plan cross-sectional assembly view of the fan as shown in FIG. 3.
Figure 3:
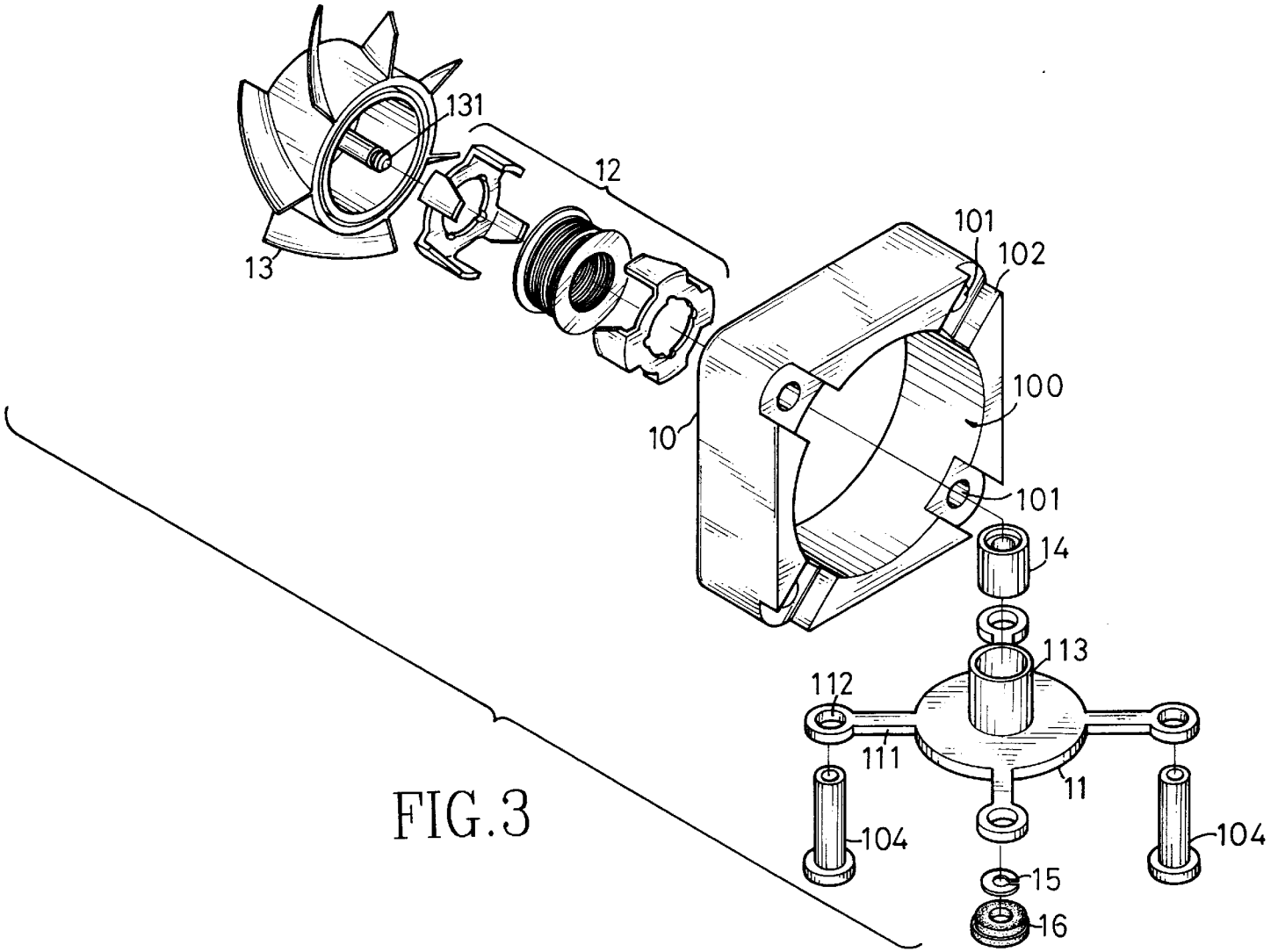
FIG. 3 is an exploded perspective view of a fan for a notebook computer in accordance with a second embodiment of the present invention.
Figure 5:
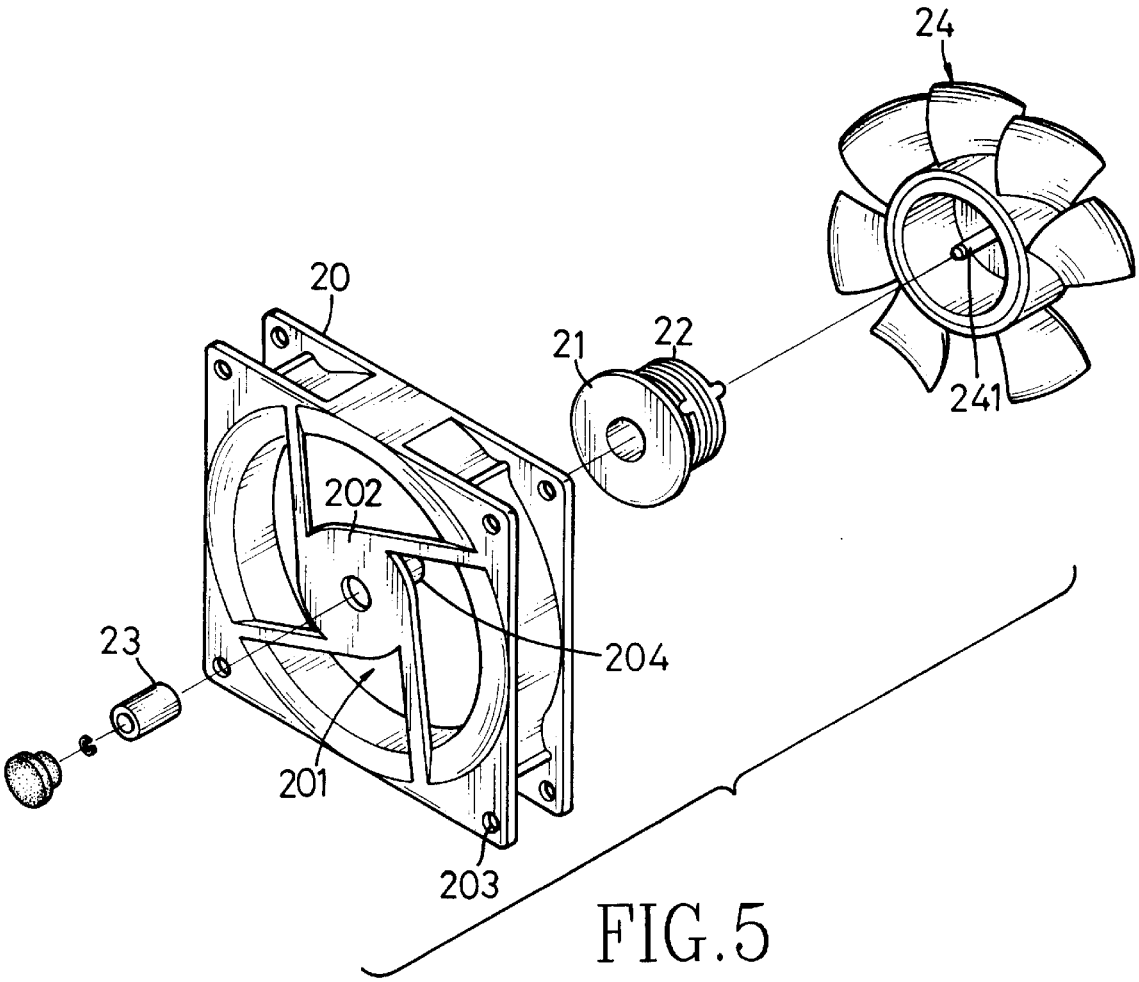
FIG.5 PRIOR ART
FIG. 5 is an exploded perspective view of a conventional fan for a notebook computer in accordance with the prior art.
Figure 6:
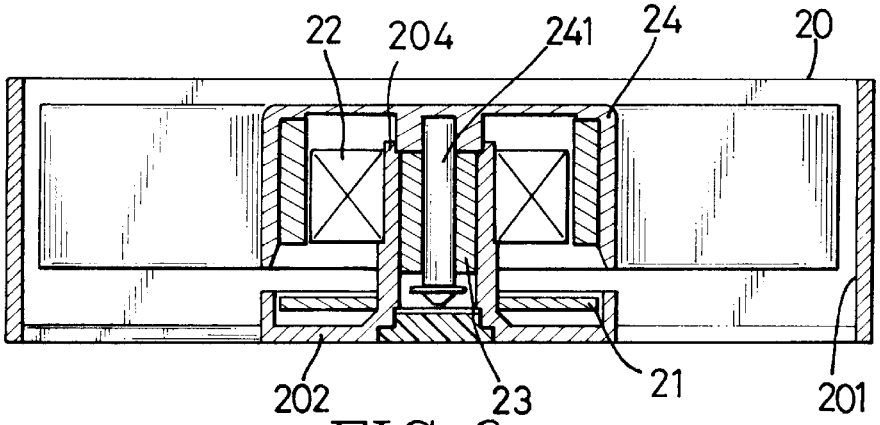
FIG.6 PRIOR ART
FIG. 6 is a top plan cross-sectional assembly view of the conventional fan as shown in FIG. 3.

Referring now to FIGS. 3 and 4, in accordance with a second embodiment of the present invention, the housing (10) contains four receiving recesses (102) each superimposed over one of the four locking bores (101). The circuit board (11) includes four extension pieces (111) each received in one of the four receiving recesses (102) and each containing a locking hole (112) aligning with one of the four locking bores (101). The fan further comprises four hollow locking pins (104) each extending through the locking hole (112) of one of the corresponding extension pieces (111), and the locking bore (101) of one of the corresponding recesses (102), thereby securing the circuit board (11) to the housing (10). Each of four locking bolts (not shown) in turn extends through one of the corresponding locking pins (104), thereby securing the fan to the radiator board of the notebook computer.

In such a manner, the circuit board (11) is directly secured in the housing (10) without a need to provide a support base as is disclosed in the conventional fan, thereby reducing the thickness of the housing (10), and thereby reducing the weight of the housing (10) such that the total thickness and weight of the fan can be decreased, thereby enhancing the versatility of the fan for the notebook computer.

It should be clear to those skilled in the art that further embodiments may be made without departing from the scope and spirit of the present invention.

What is claimed is:

1. A fan comprising:

a housing (10) containing a receiving space (100) longitudinally defined therethrough and having a first side and a second side, said first side containing a plurality of receiving recesses (102) transversely defined therein each connecting to said receiving space (100);

a circuit board (11) received in said receiving space (100) and including a plurality of elongated extension pieces (111) each extending outward from the periphery thereof and each secured in one of said corresponding receiving recesses (102);

an axial sleeve (113) mounted on said circuit board (11) and received in said receiving space (100);

a bearing (14) mounted in said axial sleeve (113);

a stator (12) mounted on said axial sleeve (113) and received in said receiving space (100); and fan blades (13) rotatably mounted on said stator (12) and received in said receiving space (100), said fan blades (13) including an axle (131) rotatably mounted in said bearing (14).

2. The fan in accordance with claim 1, wherein each of said extension pieces (111) contains a locking hole (112) defined therein, and each of said receiving recesses (102) includes a locking stub (103) securely received in said locking hole (112) of one of said corresponding extension pieces (111).

3. The fan in accordance with claim 1, wherein each of said extension pieces (111) contains a locking hole (112) defined therein, each of said receiving recesses (102) contains a locking bore (101) defined therein and aligning with said locking hole (112) of one of said corresponding extension pieces (111), and said fan further comprises a plurality of locking pins (104) each extending through said locking hole (112) of one of said corresponding extension pieces (111), and said locking bore (101) of one of said corresponding recesses (102).

4. The fan in accordance with claim 1, wherein said extension pieces (111) are symmetrically arranged on the periphery of said circuit board (11).

5. The fan in accordance with claim 1, wherein said receiving recesses (102) are symmetrically arranged in said first side of said housing (10).

6. The fan in accordance with claim 1, wherein said housing (10) contains a plurality of locking bores (101) each longitudinally defined through the periphery thereof.

* * * * *